US010053959B2

(12) United States Patent
Ayub et al.

(10) Patent No.: US 10,053,959 B2
(45) Date of Patent: Aug. 21, 2018

(54) SYSTEM AND METHOD FOR CONDENSATE BLOCKAGE REMOVAL WITH CERAMIC MATERIAL AND MICROWAVES

(71) Applicant: Saudi Arabian Oil Company, Dhahran (SA)

(72) Inventors: Muhammad Ayub, Dhahran (SA); Sameeh I. Batarseh, Dhahran (SA); Nabeel S. Habib, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 205 days.

(21) Appl. No.: 15/144,990

(22) Filed: May 3, 2016

(65) Prior Publication Data

US 2016/0326839 A1 Nov. 10, 2016

Related U.S. Application Data

(60) Provisional application No. 62/157,237, filed on May 5, 2015.

(51) Int. Cl.

| | |
|---|---|
| ***E21B 36/04*** | (2006.01) |
| ***E21B 47/06*** | (2012.01) |
| ***H05B 6/72*** | (2006.01) |
| ***H05B 6/80*** | (2006.01) |

(Continued)

(52) U.S. Cl.

CPC ..... *E21B 36/04* (2013.01); *E21B 47/065* (2013.01); *H05B 6/72* (2013.01); *H05B 6/80* (2013.01); *E21B 37/00* (2013.01); *E21B 43/2401* (2013.01); *H05B 2206/045* (2013.01)

(58) Field of Classification Search

CPC ..... E21B 36/04; E21B 47/065; E21B 37/00; E21B 43/2401; E21B 43/12; H05B 6/72; H05B 6/80; H05B 2206/045

See application file for complete search history.

(56) References Cited

U.S. PATENT DOCUMENTS

| | | | |
|---|---|---|---|
| 2,720,265 | A | 10/1955 | Tracht |
| 2,736,381 | A | 2/1956 | Allen |
| 2,757,738 | A | 8/1956 | Ritchey |

(Continued)

FOREIGN PATENT DOCUMENTS

| | | | |
|---|---|---|---|
| FR | 2274334 | B1 | 8/1979 |
| WO | 2010023519 | A1 | 3/2010 |

(Continued)

OTHER PUBLICATIONS

International Search Report and Written Opinion for related PCT application PCT/US2016/030495 dated Jul. 22, 2016.

(Continued)

*Primary Examiner* — Yong-Suk Ro

(74) *Attorney, Agent, or Firm* — Bracewell LLP; Constance G. Rhebergen; Kevin R. Tamm

(57) ABSTRACT

Systems and methods for reducing or removing condensate blockage in a natural gas wellbore and a near-wellbore formation. Microwaves are used to heat a ceramic-containing material within a near-wellbore formation. Heat is transferred from the ceramic-containing material to the near-wellbore formation. Any gas condensate reservoirs in the near well-bore formation are heated, and condensed liquids accumulated around the wellbore are re-evaporated.

36 Claims, 6 Drawing Sheets

(51) Int. Cl.

| | |
|---|---|
| *E21B 37/00* | (2006.01) |
| *E21B 43/24* | (2006.01) |

(56) References Cited

U.S. PATENT DOCUMENTS

| | | | |
|---|---|---|---|
| 2,767,791 | A | 10/1956 | van Dijck |
| 3,149,668 | A | 9/1964 | Arendt |
| 3,493,050 | A | 2/1970 | Kelley et al. |
| 4,140,179 | A | 2/1979 | Kasevich et al. |
| 4,401,162 | A | 8/1983 | Osborne |
| 4,485,868 | A | 12/1984 | Sresty et al. |
| 4,508,168 | A | 4/1985 | Heeren |
| 4,553,592 | A | 11/1985 | Looney et al. |
| 4,620,593 | A | 11/1986 | Haagensen |
| 4,817,711 | A | 4/1989 | Jeambey |
| 5,065,819 | A | 11/1991 | Kasevich |
| 5,082,054 | A | 1/1992 | Kiamanesh |
| 5,178,217 | A | 1/1993 | Mohammadi et al. |
| 5,190,405 | A | 3/1993 | Vinegar et al. |
| 5,299,887 | A | 4/1994 | Ensley |
| 5,318,116 | A | 6/1994 | Vinegar et al. |
| 5,829,528 | A | 11/1998 | Uthe |
| 6,012,520 | A | 1/2000 | Yu et al. |
| 6,112,808 | A | 9/2000 | Isted |
| 6,148,911 | A | 11/2000 | Gipson |
| 6,945,327 | B2 | 9/2005 | Ely et al. |
| 7,091,460 | B2 | 8/2006 | Kinzer |
| 7,170,294 | B2 | 1/2007 | Kasevich |
| 7,441,597 | B2 | 10/2008 | Kasevich |
| 7,875,120 | B2 | 1/2011 | Considine et al. |
| 8,210,256 | B2 | 7/2012 | Bridges |
| 8,431,015 | B2 | 4/2013 | Banerjee |
| 8,453,739 | B2 | 6/2013 | Parsche |
| 8,485,252 | B2 | 7/2013 | DeRouffignac et al. |
| 8,646,524 | B2 | 2/2014 | Al-Buraik |
| 8,720,549 | B2 | 5/2014 | Banerjee et al. |
| 8,813,875 | B1 | 8/2014 | Farrar et al. |
| 2007/0131591 | A1 | 6/2007 | Pringle |
| 2007/0289736 | A1 | 12/2007 | Kearl et al. |
| 2008/0073079 | A1 | 3/2008 | Tranquilla et al. |
| 2008/0230219 | A1 | 9/2008 | Kaminsky |
| 2008/0265654 | A1 | 10/2008 | Kearl |
| 2009/0242196 | A1 | 10/2009 | Pao |
| 2009/0250204 | A1 | 10/2009 | Harris |
| 2010/0132921 | A1 | 6/2010 | Moskal et al. |
| 2010/0219107 | A1 | 9/2010 | Parsche |
| 2010/0294488 | A1 | 11/2010 | Wheeler et al. |
| 2011/0005745 | A1 | 1/2011 | Goodwin |
| 2011/0061859 | A1 | 3/2011 | Crihan |
| 2012/0067580 | A1 | 3/2012 | Parsche |
| 2012/0073798 | A1 | 3/2012 | Parsche et al. |
| 2012/0118565 | A1 | 5/2012 | Trautman et al. |
| 2012/0125609 | A1 | 5/2012 | Parsche |
| 2012/0205109 | A1 | 8/2012 | Bumham et al. |
| 2012/0305239 | A1 | 12/2012 | Sultenfuss et al. |
| 2014/0041940 | A1 | 2/2014 | Shnell |
| 2014/0301017 | A1 | 10/2014 | Diehl et al. |
| 2015/0021008 | A1* | 1/2015 | Batarseh ..... E21B 43/24 166/57 |
| 2015/0021013 | A1 | 1/2015 | Batarseh |

FOREIGN PATENT DOCUMENTS

| | | | | |
|---|---|---|---|---|
| WO | 2012038814 | A2 | 3/2012 | |
| WO | WO 2012038814 | * | 3/2012 | ..... E21B 43/24 |
| WO | 2013060610 | A1 | 5/2013 | |

OTHER PUBLICATIONS

M. Pigott, "Wellbore Heating to Prevent Liquid Loading," paper SPE 77649, presented at the SPE Annual Technical Conference and Exhibition, San Antonio, TX, Sep. 29-Oct. 2, 2002.

M. Kamal, "Gas Well Deliquification Using Microwave Heating," paper SPE 141215, presented at the SPE Production and Operations Symposium, Oklahoma City, Oklahoma, Mar. 27-29, 2011.

P. Moses, "Gas-Condensate Reservoirs," Chapter 39, Petroleum Engineering Handbook, published by SPE, Richardson, Texas, 1987.

T. Ahmed, "Fundementals of Reservoir Fluid Behavior," Chapter 1, Reservoir Engineering Handbook, published by Gulf Publishing Company, Texas , 2007.

B.Craft, "Gas Condensate Reservoirs," Chapter 2, Applied Petroleum Reservoir Engineering, published by Prentice Hall, New Jersey, 1959.

H. Beggs, "Gas Reservoir Performance, Chapter 3, & Total System Analysis, Chapter 6," Gas Operations, published by OGCI, Tulsa, Oklahoma, 2002.

M. Sayed, "Liquid Bank Removal in Production Wells Drilled in Gas-Condensate Reservoirs: A Critical Review," paper SPE 168153, presented at the SPE International Symposium and Exhibition on Formation Damage Control, Lafayette, Louisiana, Feb. 26-28, 2014.

D. Bennion, "Retrograde Condensate Dropout Phenomena in Rich Gas Reservoirs—Impact on Recoverable Reserves, Permeability, Diagnosis, and Stimulation Techniques," Technical Note, JCPT, vol. 40, No. 12, Dec. 2001.

A.K.M. Jamaluddin, "Downhole Heating Device to Remediate Near-Wellbore Formation Damage Related to Clay Swelling and Fluid Blocking," Paper 98-73, presented at the 49th Annual Technical Meeting of the Petroleum Society of CIM, Calgary, Alberta, Jun. 8-10, 1998.

T. Straub, An Investigation Into Practical Removal of Downhole Paraffin by Thermal Methods and Chemical Solvents, paper SPE 18889, presented at the SPE Production Operations Symposium, Oklahoma City, Oklahoma , Mar. 13-14, 1989.

PCT International Search Report and Written Opinion, dated Mar. 13, 2015, for related PCT Application PCT/US2014/046831.

PCT International Preliminary Report on Patentability and Written Opinion dated Jan. 19, 2016, for related PCT application PCT/US2014/046831.

* cited by examiner

SYSTEM AND METHOD FOR CONDENSATE BLOCKAGE REMOVAL WITH CERAMIC MATERIAL AND MICROWAVES

PRIORITY CLAIM

The present application is a non-provisional application claiming priority to provisional U.S. App. No. 62/157,237, filed May 5, 2015, the entire disclosure of which is incorporated here by reference.

BACKGROUND

1. Field

The present disclosure relates to operations in a wellbore associated with the production of hydrocarbons. More specifically, the disclosure relates to systems and methods for reducing or removing condensate blockage in and around a natural gas wellbore.

2. Description of the Related Art

During production of natural gas from a wellbore, as the flowing bottomhole pressure declines to less than the dew-point pressure of the natural gas, heavier components of natural gas condense into liquid and dropout of the gas phase. Condensation of liquids results in near-wellbore formation damage (or blockage), which is caused by not only accumulation of condensed hydrocarbons, but also by the accumulation of formation water during the production process from most gas fields. The severity of liquid condensation and accumulation around wellbores depends upon the composition of gas, operating pressure and temperature, and the reservoir rock properties such as porosity and permeability. In general, a greater pressure drop, lesser near-wellbore temperature, heavier gas contents, lesser near-wellbore porosity, and lesser near-wellbore permeability are contributing factors for this type of formation damage. The accumulated liquids can impede gas flow paths from the reservoir towards the wellbore once they reach a critical saturation level. Consequently, gas production rates and overall recovery can be significantly reduced. In many severe cases, the well has to be abandoned because of uneconomical well performance.

Similarly, for low pressure gas reservoirs, when natural gas enters into a wellbore, enhanced condensation of liquids can occur as the natural gas rapidly expands within the wellbore and cools in transit to the surface. Free liquids, or "condensates" (oil and water), from the reservoir can also enter a wellbore along with the natural gas being produced. Initially, the natural gas stream in transit to the surface can carry these liquids up-hole by viscous drag forces. However, as reservoir pressure depletes in mature wellbores, the velocity of the gas stream is often reduced to less than a "critical velocity" that is required to carry the liquids to the surface. Thus, at less than the critical velocity, liquids begin to accumulate in the wellbore in a phenomenon called "liquid loading." Liquid loading in a low-pressure wellbore can inhibit the production of natural gas from the wellbore. For instance, accumulation of liquids increases the back-pressure against the flowing bottom hole pressure, which can result in a cessation of production. Additionally, accumulated liquids can interact with an inner lining of production tubing, yielding corrosion and scaling.

Well deliquification and liquid-unloading techniques can be employed to remove accumulated liquids from a wellbore and near-wellbore formation. Generally, for well-deliquification, submersible pumping systems can be installed in a wellbore, or techniques such as plunger lifting can be employed, in which a plunger is raised through the tubing of a wellbore to sweep liquids to the surface for removal. Typically, these procedures, which attempt to remove liquid that has already accumulated in a wellbore, are associated with relatively great operating costs and often require temporarily shutting down, or cycling the wellbore. Most techniques suggest controlling condensate issues (within wellbores and near-wellbore areas) by maintaining flowing bottomhole wellbore pressure greater than the dew-point conditions to produce gas economically. This conventional approach, however, has many limitations including early well abandonment because of the rapid pressure decline in many gas-condensate reservoirs.

SUMMARY

There is a need for efficient and economical systems and methods for removal of condensed fluids from the wellbore and near-wellbore regions. Described are systems and methods for reducing or removing condensate blockage in and around a wellbore producing hydrocarbons, for example natural gas. Microwaves are used to heat a ceramic-containing material within a near-wellbore formation. Heat is transferred from the ceramic-containing material to the near-wellbore formation. Any gas condensate, or other condensed fluid, reservoirs in the near-wellbore formation are heated, and condensed liquids accumulated around the wellbore are re-evaporated. In formations with little or no gas condensate reservoirs, maintaining near-wellbore formation temperature greater than the dew-point line of fluids can improve gas recovery from reservoirs by preventing or reducing accumulation of condensates.

Maintenance of the production fluid in the vapor phase avoids condensation associated with liquid loading and reduces the corrosive effects of the production fluid on the production tubing. The systems and methods described can be used to rapidly heat a near-wellbore formation to a desired temperature in a timely, efficient, and low-cost way in order to remove condensed fluid from near-wellbore formations in wells used in hydrocarbon recovery.

According to one aspect of the disclosure, described is a system for deliquifying a wellbore and a near-wellbore formation by reducing the presence of condensed fluid. The system includes a ceramic-containing material disposed within the wellbore and proximate to a reservoir formation, where the reservoir formation comprises hydrocarbon-bearing strata and a microwave producing unit operable to produce microwaves which heat the ceramic-containing material. The microwave producing unit comprises a microwave antenna disposed within the wellbore and proximate the ceramic-containing material. The ceramic-containing material is operable to be heated to a first temperature by absorbing microwaves produced by the microwave producing unit and is operable to heat the reservoir formation proximate the wellbore to a second temperature. The second temperature is operable to evaporate the condensed fluid, such that fluid condensation is mitigated in the vicinity of the wellbore.

In some embodiments, the microwave antenna is disposed within the wellbore proximate a tubing string. In other embodiments, the ceramic-containing material is operable to heat the reservoir formation proximate the wellbore to a third temperature, where the third temperature is greater than a cricondentherm temperature of the reservoir formation. In some embodiments, the ceramic-containing material includes a ceramic made from natural clay, where the natural clay comprises at least one compound selected from the group consisting of silica, alumina, magnesium oxide, potassium, iron oxide, calcium oxide, sodium oxide, titanium oxide, and mixtures thereof. Still in other embodiments, the ceramic-containing material comprises between 50% and 70% by volume of the ceramic.

In certain embodiments, the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide. Still in other embodiments, the ceramic-containing material can be heated to between 800° C. and 1000° C. In some embodiments, the ceramic-containing material further comprises gravel particulate. In some embodiments, the wellbore comprises an open-hole liner. Still in other embodiments, the wellbore is under-reamed. In certain embodiments, the wellbore further comprises cement and a casing with perforations. Still in other embodiments, the condensed fluid is at least one material selected from the group consisting of water, wax, asphaltenes, gas-hydrates, and mixtures thereof.

Also disclosed is a method of using any of the systems previously described to deliquify the wellbore and the near-wellbore formation. The method includes the steps of activating the microwave producing unit, heating the ceramic-containing material to the first temperature, the first temperature being selected such that the first temperature is operable to sufficiently heat the reservoir formation proximate the wellbore to the second temperature, and monitoring the wellbore for the presence of liquids in a production fluid. The method further includes the step of adjusting an operating parameter of the microwave producing unit to create sufficient heat in the ceramic-containing material to be transferred to the reservoir formation proximate the wellbore, such that fluid condensation is mitigated in the vicinity of the wellbore.

In certain embodiments, the operating parameter of the microwave is at least one operating parameter selected from the group consisting of a positioning of the microwave producing unit proximate the wellbore, an operating power level of the microwave producing unit, a number of microwave producing points on the microwave antenna, and a period of application of microwaves to the ceramic-containing material.

Also disclosed is a method of reducing the presence of condensed fluid in a wellbore and a near-wellbore formation. The method includes the steps of disposing a ceramic-containing material within the wellbore and proximate to a reservoir formation, where the reservoir formation comprises hydrocarbon-bearing strata and providing a microwave producing unit operable to heat the ceramic-containing material, where the microwave producing unit comprises a microwave antenna disposed within the wellbore and proximate the ceramic-containing material. The method further includes the steps of activating the microwave producing unit to heat the ceramic-containing material, where the ceramic-containing material is operable to absorb microwaves produced by the microwave producing unit and heating the ceramic-containing material to a first temperature, the first temperature operable to heat the reservoir formation proximate the wellbore to a second temperature, where the second temperature is sufficient to evaporate the condensed fluid, such that fluid condensation is mitigated in the vicinity of the wellbore.

In some embodiments, the microwave antenna is disposed within the wellbore proximate a tubing string. In other embodiments, the method includes the step of heating the reservoir formation proximate the wellbore to a third temperature, where the third temperature is greater than a cricondentherm temperature of the reservoir formation. In certain embodiments, the method further includes the step of determining a cricondentherm temperature of the reservoir formation before activating the microwave producing unit. Still in other embodiments, the ceramic-containing material comprises a ceramic made from natural clay, where the natural clay includes at least one compound selected from the group consisting of silica, alumina, magnesium oxide, potassium, iron oxide, calcium oxide, sodium oxide, titanium oxide, and mixtures thereof.

In certain embodiments of the method, the ceramic-containing material comprises between 50% and 70% by volume of the ceramic. Still in some other embodiments, the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide. In certain embodiments, the ceramic-containing material can be heated to between 800° C. and 1000° C. In some embodiments, the step of disposing a ceramic-containing material within the wellbore further comprises mixing the ceramic-containing material with gravel particulate. Still in other embodiments, the step of disposing a ceramic-containing material within the wellbore further comprises disposing the ceramic-containing material within an open-hole liner. And in other embodiments of the method, the condensed fluid is at least one material selected from the group consisting of water, wax, asphaltenes, gas-hydrates, and mixtures thereof.

Also disclosed is a method for constructing a wellbore in a hydrocarbon-bearing formation to reduce formation of condensed fluid near the wellbore. The method comprises the steps of forming the wellbore in the hydrocarbon-bearing formation, the wellbore comprising a wellbore wall, the wellbore wall defining an interface between the wellbore and the hydrocarbon-bearing formation and positioning a liner into the wellbore such that an annular void is formed between an exterior-directed surface of the liner and an interior-directed surface of the wellbore wall. The method further includes the steps of introducing a ceramic-containing material into the annular void and proximate to the hydrocarbon-bearing formation and securing the liner such that the ceramic-containing material is maintained in the annular void at a location to be treated with microwave heating. The method further includes the step of introducing into the wellbore a microwave producing unit operable to produce microwaves which heat the ceramic-containing material, where the microwave producing unit comprises a microwave antenna, disposed within the wellbore and proximate the ceramic-containing material, where the ceramic-containing material is operable to be heated to a first temperature by absorbing microwaves produced by the microwave producing unit and is operable to heat the reservoir formation proximate the wellbore to a second temperature, and where the second temperature is operable to evaporate condensed fluid, such that fluid condensation is reduced in the vicinity of the wellbore.

In some embodiments, the step of forming the wellbore further comprises the step of extending a radial circumference of a first portion of the wellbore to a radially-larger, under-reamed circumference relative to a second portion of the wellbore, where a radial circumference of the second portion of the wellbore is less than the radial circumference of the radially-larger, under-reamed circumference. In other embodiments, the method further comprises the step of disposing cement within the annular void. Still in other embodiments, the method further includes the step of disposing a casing within the annular void. In yet other embodiments, the method further comprises the step of perforating the cement and the casing, such that a hydrocarbon fluid flow is permitted through the perforations radially inward from the wellbore wall. Still in other embodiments, the step of introducing into the wellbore the microwave producing unit further comprises disposing the microwave producing unit within the wellbore proximate a tubing string.

In certain aspects, the ceramic-containing material is operable to heat the reservoir formation proximate the wellbore to a third temperature, where the third temperature is greater than a cricondentherm temperature of the reservoir formation. In other aspects, the ceramic-containing material comprises a ceramic made from natural clay, where the natural clay comprises at least one compound selected from the group consisting of silica, alumina, magnesium oxide, potassium, iron oxide, calcium oxide, sodium oxide, titanium oxide, and mixtures thereof. In some embodiments, the ceramic-containing material comprises between 50% and 70% by volume of the ceramic. In other embodiments, the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide.

Still in other embodiments, the ceramic-containing material can be heated to between 800° C. and 1000° C. In certain embodiments, the ceramic-containing material further comprises gravel particulate. Still in yet other aspects, the step of positioning a liner further comprises the step of positioning an open-hole liner within the wellbore. In some embodiments, the condensed fluid is at least one material selected from the group consisting of water, wax, asphaltenes, gas-hydrates, and mixtures thereof.

BRIEF DESCRIPTION OF THE DRAWINGS

So that the manner in which the previously-recited features, aspects and advantages of the disclosure, as well as others that will become apparent, are attained and can be understood in detail, a more particular description of the embodiments briefly summarized previously can be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure can admit to other equally effective embodiments.

DETAILED DESCRIPTION OF THE EMBODIMENTS

Figure 1:
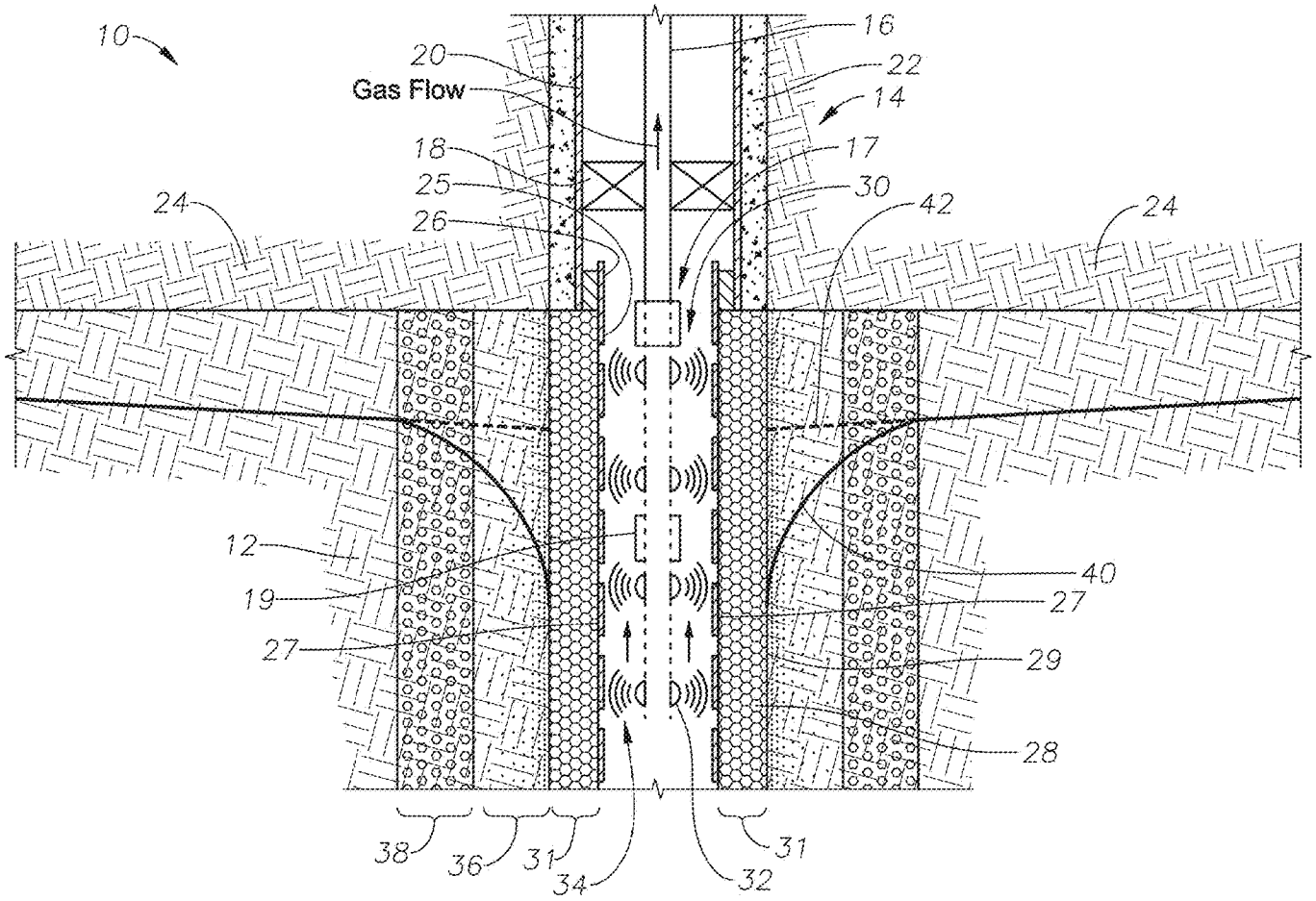
FIG. 1 is a schematic view of an embodiment of a microwave deliquification system in accordance with the present disclosure for reducing or removing condensate blockage in and around a natural gas wellbore, including a microwave antenna and ceramic-containing material.

Shown in side sectional view in FIG. 1 is one embodiment of a microwave deliquification system 10. As shown, a hydrocarbon-bearing reservoir 12 includes a wellbore 14, which itself includes tubing 16, packer 18, a casing 20, and cement 22. The wellbore 14 proceeds through a cap rock 24 into the hydrocarbon-bearing reservoir 12. While in some embodiments the systems and methods of the present disclosure are used to reduce or remove condensates near the wellbore in a hydrocarbon-bearing reservoir by heating, the systems and methods can be used in other reservoir types for other applications. The systems and methods can be used for heating in oil reservoirs for heavy-oil and bitumen recovery with a single well process, also known as "huff-n-puff" (using steam injection), and for enhanced oil recovery displacement processes using multiple wells.

Figure 3:
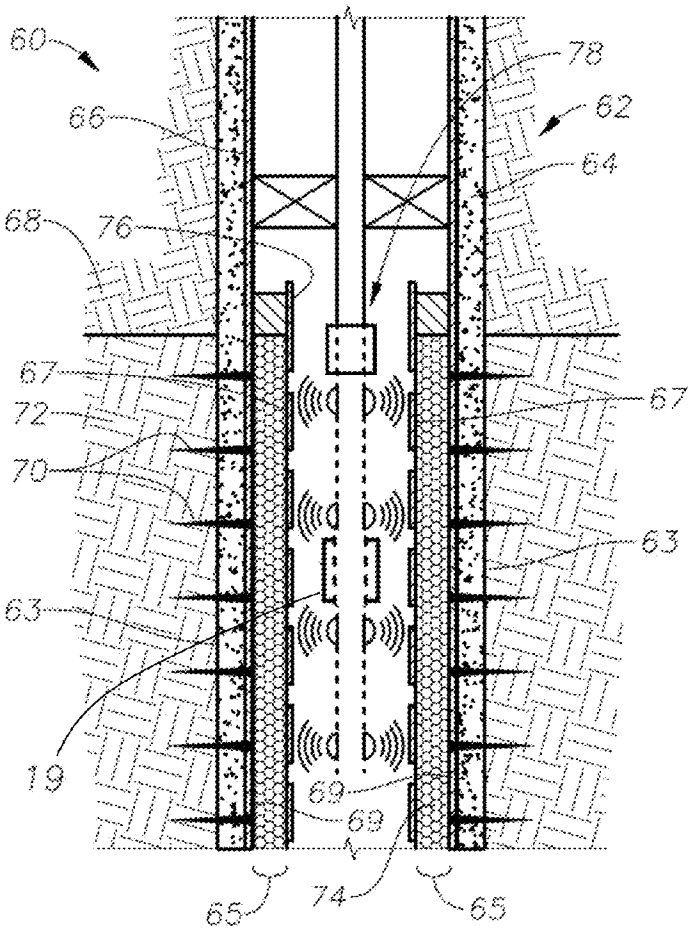
FIG. 3 is a schematic view of an embodiment of a microwave deliquification system in accordance with the present disclosure utilized with perforations and an open-hole liner.

Still referring to FIG. 1, wellbore 14 further includes an open-hole liner 26, which proceeds downwardly into the wellbore 14 from the cap rock 24. The open-hole liner 26 is disposed within the wellbore 14 and retains a ceramic-containing material 28 between the open-hole liner 26 and the hydrocarbon-bearing reservoir 12. The open-hole liner 26 has an interior-directed surface 25 and an exterior-directed surface 27, which is in communication with the ceramic-containing material 28. As shown, the casing 20 and the cement 22 do not proceed below the cap rock 24. However, in other embodiments, the casing and the cement can proceed downwardly below the cap rock, and optionally have perforations, as shown in FIG. 3 and described as follows.

In the embodiment of FIG. 1, the radially-outward limit of the wellbore 14 is defined by a wellbore wall 29. The wellbore wall 29 is the contact or physical interface between the hydrocarbon-bearing reservoir 12 and the ceramic-containing material 28. An annular void 31 is formed between the exterior-directed surface 27 of the liner 26 and the wellbore wall 29. The annular void 31 secures the ceramic-containing material 28 between the liner 26 and the wellbore wall 29 in such a way that the ceramic-containing material 28 can be heated by a microwave producing unit with a microwave antenna 30.

In the embodiment of FIG. 1, the microwave producing unit with the microwave antenna 30 is disposed interior to the open-hole liner 26. Microwave antenna 30 includes substantially equally spaced microwave-producing (emitting) points 32, and as shown microwave-producing (emitting) points 32 direct microwaves 34 radially outwardly or exteriorly and toward the ceramic-containing material 28, within annular void 31.

In other embodiments, non-open hole liners may be used within the wellbore, or at certain positions within wellbore.

The open-hole liner 26 allows for passage of the microwaves 34 from microwave antenna 30 into ceramic-containing material 28 within the annular void 31. The size, positioning, material composition, and number of holes in open-hole liner 26 can be adjusted for optimum passage of microwaves 34 into ceramic-containing material 28. Any suitable liner material, shape, continuity and thickness can be used which allows for passage of microwaves 34 into ceramic-containing material 28.

The microwave antenna 30 can be attached to the tubing 16, or can be disposed within the wellbore 14 separately from the tubing 16. In the embodiment of FIG. 1, the microwave antenna 30 is coupled to the tubing 16 by a coupling device 17. In some embodiments, the coupling device is a hanger used by itself or in combination with one or more of screws, bolts, brackets, adhesives, springs, actuators, cords, and other suitable coupling means known in the art. More or fewer coupling devices could be used.

In other embodiments, more than one microwave antenna could be disposed within the wellbore, and more or fewer microwave producing points could be used along the microwave antenna 30. The microwave antenna 30 can be controlled by a user from the surface away from the wellbore 14, and the microwave antenna 30 can be powered by any means known in the art including, but not limited to, any one of or any combination of solar, combustion, and wind power.

Examples of suitable microwave producing units for use with the microwave antenna 30 can include those such as the VKP-7952 Klystron models produced by Communications & Power Industries (CPI)/Microwave Power Products (MPP), with headquarters at 607 Hansen Way Palo Alto, Calif. 94304, and microwave units produced by Industrial Microwave Systems, L.L.C, with headquarters at 220 Laitram Lane New Orleans, La. 70123. Modifications to these or similar systems can be made by those of ordinary skill in the art for optimum use within the system of FIG. 1. Microwave systems have been used in heavy oil recovery techniques using microwaves as thermal means to reduce oil viscosity for better oil mobility towards wells in heavy oil reservoirs. In embodiments of the present disclosure, microwaves can be generated downhole instead of, or in addition to, delivering the microwaves from a surface generator.

In the embodiment of FIG. 1, downhole thermostats 19 are coupled to the microwave antenna 30 to detect the temperature of the wellbore 14 and areas proximate to the wellbore 14, such as a heated region 36. In the embodiment of FIG. 1, the microwave antenna 30 maintains the temperature of the wellbore 14 and proximate area, such as the heated region 36, greater than a cricondentherm temperature of the hydrocarbon-bearing reservoir 12. Cricondentherm temperature is described further as follows with regard to FIG. 5. By maintaining the temperature at temperatures greater than the cricondentherm temperature, this allows gas production as a single-phase by keeping the operating conditions of temperature and pressure out of a two-phase region, or a region where the gas contains both liquid fluid and gas vapor.

In the embodiment of FIG. 1, the downhole thermostats 19 detect the temperature proximate the wellbore 14, and if the temperature drops to less than a known, pre-set cricondentherm temperature, the microwave antenna 30 is adjusted to increase the temperature. For instance, the downhole thermostats 19 can wirelessly signal surface controls (not shown) to either automatically increase the power (WATTAGE) to the microwave antenna 30, or the downhole thermostats 19 can wirelessly signal surface controls to prompt a user to increase the power to the microwave antenna 30.

In other embodiments, more or fewer downhole thermostats could be used, and could be placed anywhere proximate the wellbore suitable for accurately measuring the temperature near the wellbore in the formation. In other embodiments, any other suitable temperature detection means could be used instead of or in combination with downhole thermostats. Any downhole temperature detection means can be connected by either or both of wired and wireless means to surface controls. If the temperature detected downhole is less than or decreasing to approach a known, pre-set cricondentherm temperature, the surface controls can be programmed to automatically increase the intensity of the microwave antenna 30, or the surface controls can be programmed to prompt a user that the temperature downhole is approaching or has dropped to less than a cricondentherm temperature and that the power to the microwave antenna 30 should be increased. Other operating parameters of the microwave antenna 30 could also be adjusted, such as the length of the active run time.

In some embodiments, the microwave antenna would run only to raise and maintain a pre-determined temperature level that is reasonably greater than a known cricondentherm temperature of a reservoir, near the wellbore. In the embodiment of FIG. 1, the surface controls can be set to deactivate the microwave antenna 30 once the downhole thermostats 19 detect that the desired temperature level is reached. The surface controls can be programmed such that the system will re-activate once the downhole temperature approaches the cricondentherm temperature through cooling. The sequence of activating and deactivating the microwave antenna 30 can continue as required to keep the temperature of the wellbore 14 and proximate areas such as the heated region 36 at temperatures greater than the cricondentherm temperature.

In the microwave deliquification system 10 of FIG. 1, the microwave antenna 30 is installed below the coupling device 17. In some embodiments, by housing a microwave antenna in a microwave transparent material, the antenna can be protected from harsh wellbore environments, which may exhibit extremely high temperature, pressure, and erosion caused by possible sand production.

The microwave producing points 32 along the microwave antenna 30 heat the ceramic-containing material 28, which in turn produces the heated region 36 within the hydrocarbon-bearing reservoir 12. The heated region 36 is disposed within the hydrocarbon-bearing reservoir 12 along the wellbore wall 29, opposite of the open-hole liner 26.

The extent of the heated region 36 into the hydrocarbon-bearing reservoir 12 will depend upon many factors, including, but not limited to, characteristics of the microwave antenna 30, characteristics of the hydrocarbon-bearing reservoir 12, and operating conditions of the microwave deliquification system 10, including the type and amount of the ceramic-containing material 28. The heated region 36 can reduce the formation of and remove the presence of a condensate in wellbore 14, heated region 36, dropout region 38, and areas of hydrocarbon-bearing reservoir 12 radially outward from dropout region 38. In the condensate dropout region 38, condensate forms as described with reference to the phase diagram of FIG. 5. In some embodiments, as the temperature of the reservoir declines with age, fluid in vapor form will condense at lesser temperatures to a condensed fluid.

Condensate dropout, or condensed fluids, in the condensate dropout region 38 significantly hinder gas production rates from hydrocarbon-bearing reservoirs. By reducing the formation of and removing the presence of the condensate dropout region 38, upward gas flow through wellbore 14 is increased. By increasing the temperature in the heated region 36, condensed fluids in the condensate dropout region 38 are re-evaporated into and maintained in the vapor phase.

For example, in the embodiment shown, the microwave antenna 30 is activated by a user to produce the microwaves 34 which are emitted radially outwardly to heat ceramic-containing material 28. The ceramic-containing material 28 is heated to a first temperature, which in turn heats the heated region 36 to a second temperature. Ideally, the second temperature is at or greater than the temperature required to evaporate condensed fluids in the condensate dropout region 38.

While the system of FIG. 1 can be used for the complete or partial reduction and removal of gas-condensate accumulated around gas wells, the technology of the present disclosure can also be used in the following circumstances: complete or partial reduction and removal of water accumulated around oil and gas wells; complete or partial reduction and removal of wax accumulated around oil wells; complete or partial reduction and removal of asphaltenes accumulated around oil wells; complete or partial reduction and removal of gas-hydrates accumulated around gas wells; clay stabilization around oil and gas wells to minimize the formation damage and to improve the flow conditions; improving oil and gas well performance by minimizing formation damage caused during drilling processes; improving heavy-oil and bitumen recovery using single well "huff-n-puff" (also known as steam injection) processes; increasing near-wellbore formation pressures; and using multiple wells for enhanced oil recovery displacement processes.

Still referring to FIG. 1, the ceramic-containing material 28 can be substantially pure or unmixed ceramic material, and in other embodiments the ceramic-containing material can be a ceramic and gravel mixture. The ceramic material itself can be any ceramic material capable of being heated by microwaves to a suitable temperature in a suitable amount of time for reducing or removing condensate in a near-wellbore formation by heating. For example, one such ceramic material is produced by the Bezen Institute, Inc. In one embodiment, natural clays used to manufacture suitable ceramics include one or more of the following compounds in any combination: silica; alumina; magnesium oxide; potassium; iron oxide; calcium oxide; sodium oxide; and titanium oxide. The ceramics can be reusable, reshapeable, and have a long active life span, such as, for example, about 10 years.

In current wellbore systems, gravel packs are used to control sand production along the gas flow from hydrocarbon-bearing reservoirs towards wellbores. Rock mixes such as gravel have a large heat absorbing capacity, and these rocks can absorb heat and stay at a greater temperature for a longer duration than other materials, such as ceramic material by itself. Ceramic materials of the present embodiments, however, have a rapid heating ability when exposed to microwaves. Mixing ceramic with an appropriate rock mix, such as gravel, serves at least two purposes: (1) the total ceramic volume in the mixture is reduced for economic reasons as rock mixtures such as gravel are more economical, and (2) once the ceramic material is quickly heated by being exposed to microwaves, the rock mix such as gravel can absorb a large amount of heat and sustain a high temperature for a long duration to continuously transfer heat to adjacent reservoir rocks.

A suitable mixture of ceramic and gravel material can provide better and sustained levels of heat transfer from the mixture to an adjacent region, such as the heated region 36 and dropout region 38 of FIG. 1. In some embodiments, the volume percentage of the ceramic material could be about 40%, 50%, 60%, 70%, or 80% of the total ceramic-gravel mixture volume. In one embodiment, natural clays used to manufacture suitable ceramics include about 67.5% silica, 22.5% alumina, 3.10% magnesium oxide, 0.85% potassium, 0.70% iron oxide, 0.35% calcium oxide, 0.30% sodium oxide, and 0.30% titanium oxide. As noted, such ceramics can be reusable, reshapeable, and have a long active life span, such as about 10 years.

Any suitable and advantageous particle size for the ceramic material and gravel can be used. In addition, any suitable and advantageous ratio of ceramic material to gravel, or similar rock mixes, can be used. A suitable ratio of ceramic to gravel would provide for quick heating of the ceramic material to a high temperature followed by absorption of a large amount of heat by the gravel mixture and sustained heating of the wellbore and near-wellbore formation provided by the large amount of heat absorbed by the gravel mixture. For example, certain experiments have shown that ceramic-containing material can be heated by microwaves into the temperature range of about 800° C. to about 1000° C. in about three minutes (see FIGS. 4A-C).

As depicted in FIG. 1, the ceramic-containing material 28 would be placed proximate to the "pay zone" of hydrocarbon-bearing reservoir 12, or the area from where hydrocarbons are being produced and hence condensate accumulation or blockage may occur (gas flow shown).

The ceramics used in the embodiments of the present disclosure do not quickly deteriorate, and they do not leach harmful substances when used. Therefore, these ceramics could be employed safely and for long periods of time in a wellbore formation such as, for example, about 10 years.

The system of FIG. 1 surprisingly and unexpectedly provides a unique means to reduce the formation of or remove fluid condensates by heating. Conventional microwave heating, without ceramic-containing material, does not work effectively to evaporate gas-condensate in wellbores, because there is insufficient water in the vicinity of the wellbores to effectively absorb microwave radiation and be heated. Typically, water is heated by microwaves, for example in conventional kitchen microwaves; however, in the system of FIG. 1, ceramic-containing material 28 can be quickly and efficiently heated by microwaves without the presence of water.

Without being bound by any theory or explanation, it is believed that certain minerals in the ceramic materials used in the embodiments of the present disclosure have large surface areas and have large microwave attenuation capacity that causes the rapid heating of the ceramic material in the absence of water. The ceramic-gravel mixtures of the present disclosure likely would be so hot that during operational scenarios water and oil would not be absorbed onto the ceramic; instead, any fluid proximate the ceramic material would be rapidly evaporated.

Depending on the gas composition, reservoir properties, and the operating conditions of a given well, the dropped-out or condensed liquid in a near-wellbore formation mainly consists of crude oil, which also condenses within the wellbore. This eventually reduces the production rate of gas to less than the economic limits. When the microwaves 34 interact with the ceramic-containing material 28, a tremendous amount of heat is created that can evaporate both gas-condensate and water; hence improving the near-wellbore gas flow conditions.

Figure 2:
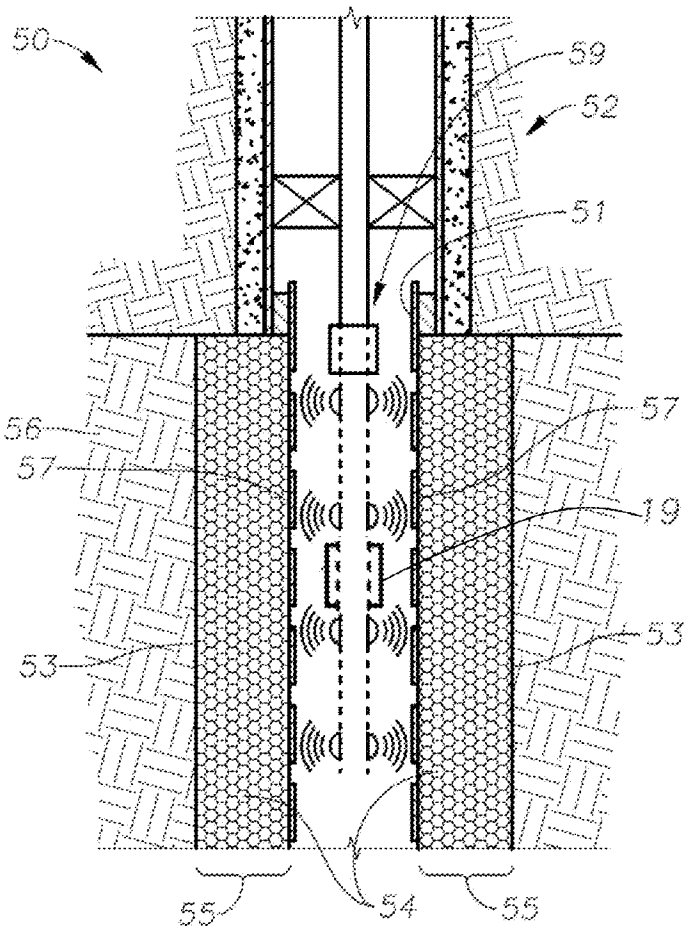
FIG. 2 is a schematic view of an embodiment of a microwave deliquification system in accordance with the present disclosure utilized with an under-reamed wellbore.

Referring now to FIG. 2, a schematic view of a microwave deliquification system 50 with an under-reamed wellbore 52 is shown. Components shown are similar to those shown in FIG. 1 and described previously. However, in the under-reamed wellbore 52, the ceramic-containing material 54 extends radially further into the hydrocarbon-bearing reservoir 56 than the ceramic-containing material 28 extends into the hydrocarbon-bearing reservoir 12 in FIG. 1. In some embodiments, an under-reamed, open-hole liner completion is preferable, because the radial thickness of the ceramic-containing material would be larger compared to other completion designs (see FIG. 1). Such a design can provide more efficient heating, and allow for longer-life of the ceramic-containing material.

In the embodiment of FIG. 2, the radially-outward limit of the under-reamed wellbore 52 is defined by a wellbore wall 53. The wellbore wall 53 is the contact or physical interface between the hydrocarbon-bearing reservoir 56 and the ceramic-containing material 54. An annular void 55 is formed between an exterior-directed surface 57 of an open-hole liner 51 and the wellbore wall 53. The annular void 55 secures the ceramic-containing material 54 between the liner 51 and the wellbore wall 53 in such a way that the ceramic-containing material 54 can be heated by a microwave producing unit with a microwave antenna 59. The annular void 55 in FIG. 2 is radially larger than the annular void 31 in FIG. 1, and this can provide enhanced heating of the hydrocarbon-bearing reservoir 56.

Referring now to FIG. 3, a schematic view of a microwave deliquification system 60 within a wellbore 62 is shown. Components shown are similar to those shown in FIGS. 1 and 2 described previously. However, in the embodiment of FIG. 3, cement 64 and a casing 66 extend below a cap rock 68 downwardly into the wellbore 62. Perforations 70 are shown to extend from a hydrocarbon-bearing reservoir 72 through the cement 64 and casing 66 into ceramic-containing material 74. The wellbore 62 is pictured with an open-hole liner 76. The perforations 70 will allow hydrocarbon flow from the hydrocarbon-bearing reservoir 72 to the wellbore 62. In some embodiments, the perforations 70 can allow for more efficient heat transfer from the ceramic-containing material 74 to the surrounding hydrocarbon-bearing reservoir 72. Any number, size, shape, and arrangement of the perforations 70 is envisioned for efficient hydrocarbon flow and heat transfer to occur between ceramic-containing material 74 and hydrocarbon-bearing reservoir 72.

In the embodiment of FIG. 3, a wellbore wall 63 is the contact or physical interface between the hydrocarbon-bearing reservoir 72 and the cement 64. An annular void 65 is formed between an exterior-directed surface 67 of the open-hole liner 76 and an interior-directed surface 69 of the casing 66. The annular void 65 secures the ceramic-containing material 74 between the liner 76 and the casing 66 in such a way that the ceramic-containing material 74 can be heated by a microwave producing unit with a microwave antenna 78. The annular void 65 in FIG. 3 is radially smaller than the annular void 55 in FIG. 2.

In some embodiments, perforations may extend into an annular void containing ceramic-containing material, and some portion of the ceramic-containing material may extend radially outwardly and into the perforations, a casing, and cement. In the embodiment shown, the perforations 70 extend from the casing 66 through the cement 64, and into the hydrocarbon-bearing reservoir 72; however, the perforations do not have a substantial amount of ceramic-containing material 74 within the perforations 70. In other embodiments, a substantial amount of ceramic-containing material may reside in perforations extending into hydrocarbon-bearing formations.

In accordance with the systems described in FIGS. 1-3, a method for creating and using one or more of such systems can include the following steps. First, a candidate hydrocarbon well, optionally containing one or both of gas and oil, would be selected, optionally with one or more pre-existing condensate issues, and optionally at risk of future condensate issues. In one embodiment, a well with open-hole completion would be selected, because in open-hole completion there will be no casing disposed between the microwave generator(s) and the ceramic-containing material. Therefore, the ceramic-containing material, optionally mixed with gravel, will be better exposed to microwaves for effective heating.

Next, one or more condensate samples would be collected from the selected well, and complete lab studies would be performed to determine fluid composition and pressure-volume-temperature (PVT) properties of the fluid in the well. In particular, a phase diagram, such as that shown in FIG. 5 and described as follows, could be developed to determine the necessary increase in temperature for the well to avoid condensates (for example, at and greater than the dew-point line and cricondentherm temperature). Thereby, the required amount of heat/energy from microwaves to increase the near-wellbore formation to this temperature could also be calculated.

Following this step, based on lab-scale experiments, the correct amount of ceramic-containing material for input into the well, between the open-hole liner and formation in an annular void, could be determined. In addition, if gravel, or a similar rock mixture, were to be mixed with the ceramic material for beneficial heat transfer properties, the ratio of ceramic material to gravel, or similar rock mixture, could be determined in lab-scale experiments.

After the preceding steps, the well could be completed with any of the typical sand control processes shown in FIGS. 1-3. As noted previously, an under-reamed, open-hole completion, such as that shown in FIG. 2, can be preferable, because in this design the radial thickness of a ceramic-gravel mix would be larger compared to the other completion designs (see FIGS. 1-3). Such a design would lead to better and long-life heating for certain wellbores. Completing the well can include any steps such as packer placement, forming perforations, and setting the liner before any hydrocarbons are produced from the well.

With the well completed, one or more microwave systems could be installed, for example as shown in FIGS. 1-3. Afterward, the microwave supply could be activated from a surface control system capable of accepting user input. The system would then remain activated during gas production to allow the near-wellbore formation and fluids to heat up to a temperature greater than the cricondentherm temperature level (see FIG. 5). The microwave antenna can run continuously to maintain the near-wellbore temperature greater than a cricondentherm temperature, or it can be run intermittently to maintain the near-wellbore temperature greater than a cricondentherm temperature. The microwave antenna can be activated and deactivated by a user, and it can be controlled by a control loop interacting with one or more temperature and pressure sensors actively tracking the temperature and pressure in the near-wellbore formation.

Heating should be continued for a sufficient time (to be determined with the help of commercially available thermal simulators such as Eclipse or CMG) to make sure most of the near-wellbore accumulated liquids are evaporated. The on/off duration of heating cycles, to maintain temperature greater than the cricondentherm level, can be controlled by at least one downhole thermostat installed with the downhole antenna. Heating of the near-wellbore formation can be performed while the well is flowing, or while production from the well is suspended.

As production continues from gas wells with time, the condensate composition and PVT properties of the well can change. This can shift the phase-diagram of the near-wellbore formation, such as that shown in FIG. 5, further to the right. To compensate for this effect, if a downhole thermostat is being used to control the operation of the microwave producing unit, and thereby control the heat applied by the ceramic-containing material to the surrounding near-wellbore environment, the thermostat should be readjusted periodically to keep the downhole operating temperature greater than the cricondentherm level.

Suitable Ceramic Materials

Figure 4A:
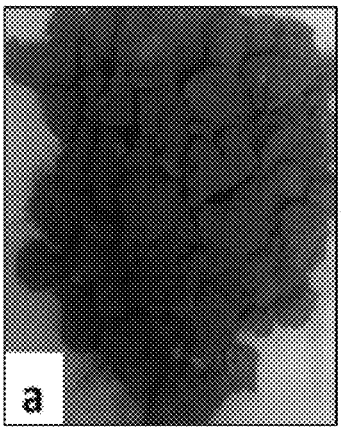
FIG. 4A is a pictorial representation of one embodiment of ceramic material for use in embodiments of the present disclosure.

Referring now to FIG. 4A, a pictorial representation of one embodiment of ceramic material for use in the systems and methods of the present disclosure is shown. FIG. 4A shows the raw form of the ceramic material at ambient conditions. Ceramic material of any suitable mesh-size can be used, and as noted previously, can be used with or without mixing with gravel. One or more advantageous mixing ratios of ceramic material to gravel, or a similar rock mixture, can be determined based on reservoir conditions and the severity and type of accumulated condensates and liquids. Various ratios of ceramic material to gravel, or a similar rock mixture, can provide advantageous heat transfer characteristics for heat transfer to the near-wellbore formation.

Figure 4B:
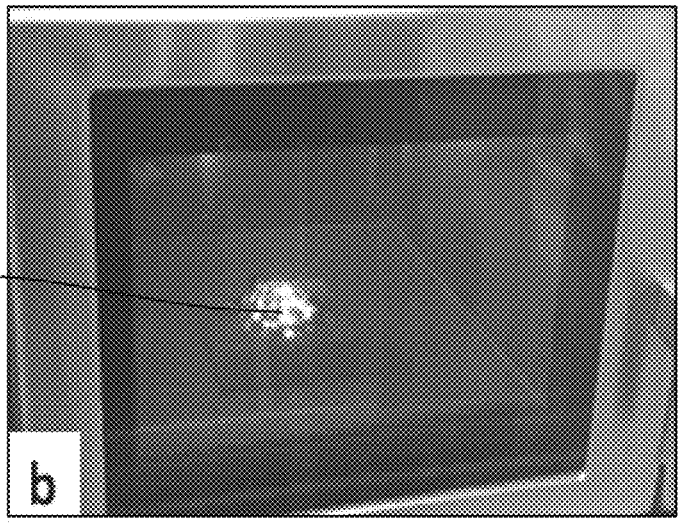
FIG. 4B is a pictorial representation of one embodiment of ceramic material for use in embodiments of the present disclosure while being provided with microwave energy.
Figure 4C:
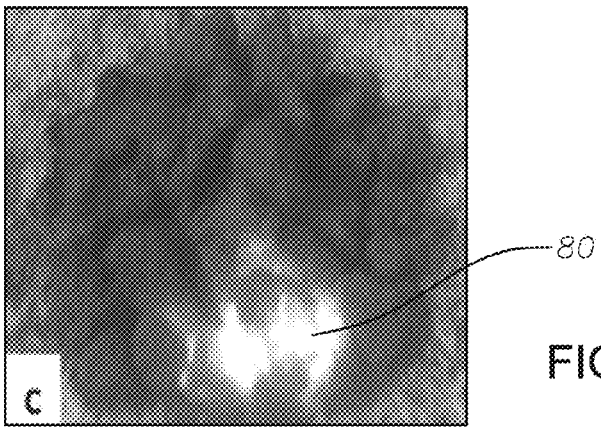
FIG. 4C is a pictorial representation of one embodiment of ceramic material for use in embodiments of the present disclosure after being provided with microwave energy.

Referring now to FIGS. 4B and 4C, pictorial representations are shown of one embodiment of ceramic material being provided with microwave energy. Heated portions 80 are shown to have absorbed microwave energy and are heated to a high temperature. Experiments have shown that temperatures in the range of about 800° C. to about 1000° C. can be achieved in about 3 minutes with a low power microwave, such as a kitchen-type microwave oven. Such experiments show that ceramic-containing materials used in combination with one or more industrial microwave antennas can provide low-cost and efficient systems and methods for heating near-wellbore formations to reduce or remove condensates.

A significant difference between ceramic materials of the present application and those in the prior art is that certain prior art suggests using a ceramic material having a large thermal conductivity as compared to surrounding wellbore rocks and fluids. Such ceramic material is to overcome a heat penetration limitation commonly encountered in cases where microwave heaters are used to reduce heavy-oil viscosity. In the prior art, ceramic materials work as heat-carrier or heat-transfer materials and do not generate additional heat. In prior art, the source of heat generation is the microwave heater only. The ceramic carries the heat away from the well to certain limits; and, as steam and vapor cools down, its effectiveness or efficiency also declines with time and distance away from the wellbore.

Quite oppositely, instead of acting as a heat carrier or thermal conductor, the ceramic material in the present application generates additional heat when the ceramic material interacts with the microwaves. FIGS. 4A-4C show the additional heat generation process. Normally, a regular kitchen type microwave can generate temperatures around 200° C.; whereas, when ceramic material of the present application is placed in the same oven, the material's temperature reached around 1000° C. within about 3 minutes. Prior art references do not suggest this ability in ceramic materials applied in oil and gas technologies. Without being bound by any theory or explanation, it is believed that certain minerals in the ceramic materials used in the embodiments of the present disclosure have large surface areas and have large microwave attenuation capacity that causes the rapid heating of the ceramic material in the absence of water. The ceramic-gravel mixtures of the present disclosure likely would be so hot that during operational scenarios water and oil would not be absorbed onto the ceramic; instead, any fluid proximate the ceramic material would be rapidly evaporated.

Moreover, in certain prior art, vapor or steam is generated downhole from injected water with the help of microwaves or a radio frequency ("RF") heater, and the steam is injected into a heavy-oil (high viscosity oil) reservoir to reduce viscosity of the oil (described as fluidization) so that it can flow towards the wellbore. Injected vapor or steam, once it enters into the reservoir, reduces the viscosity of heavy-oil or Bitumen, and then it is cooled or condensed down to become just hot-water. On the other hand, the "gas-condensate" described in the present application has no relation at all with that described in certain prior art steam generation applications.

Natural gas condensation, described in the present application, occurs in most gas wells, and is usually a near-wellbore phenomenon if the gas is produced at less than a certain pressure limit (called dewpoint pressure) while the average reservoir pressure away from the wellbore is larger than the dewpoint pressure levels. Because of lesser near wellbore pressures and temperatures, the heavier components of a typical natural gas get condensed, accumulate around wells, and block the flow paths of gas. The systems and methods of the present application enable the creation of high enough temperatures downhole near a wellbore to re-evaporate heavy components of natural gas to bring them to the surface as a gas, rather than enabling merely the creation of steam downhole to fluidize heavy oil components.

Moreover, in certain prior art applications, ceramic materials are used as insulators, and are used to insulate against heat or microwaves. In the embodiments of the present application, the ceramic materials do not act as insulators against heat or microwaves. In general, any ceramic material which is non-conductive to heat and microwaves, and cannot generate additional heat, has no relevance with the ceramic material used in the present application.

Temperature Control

Figure 5:
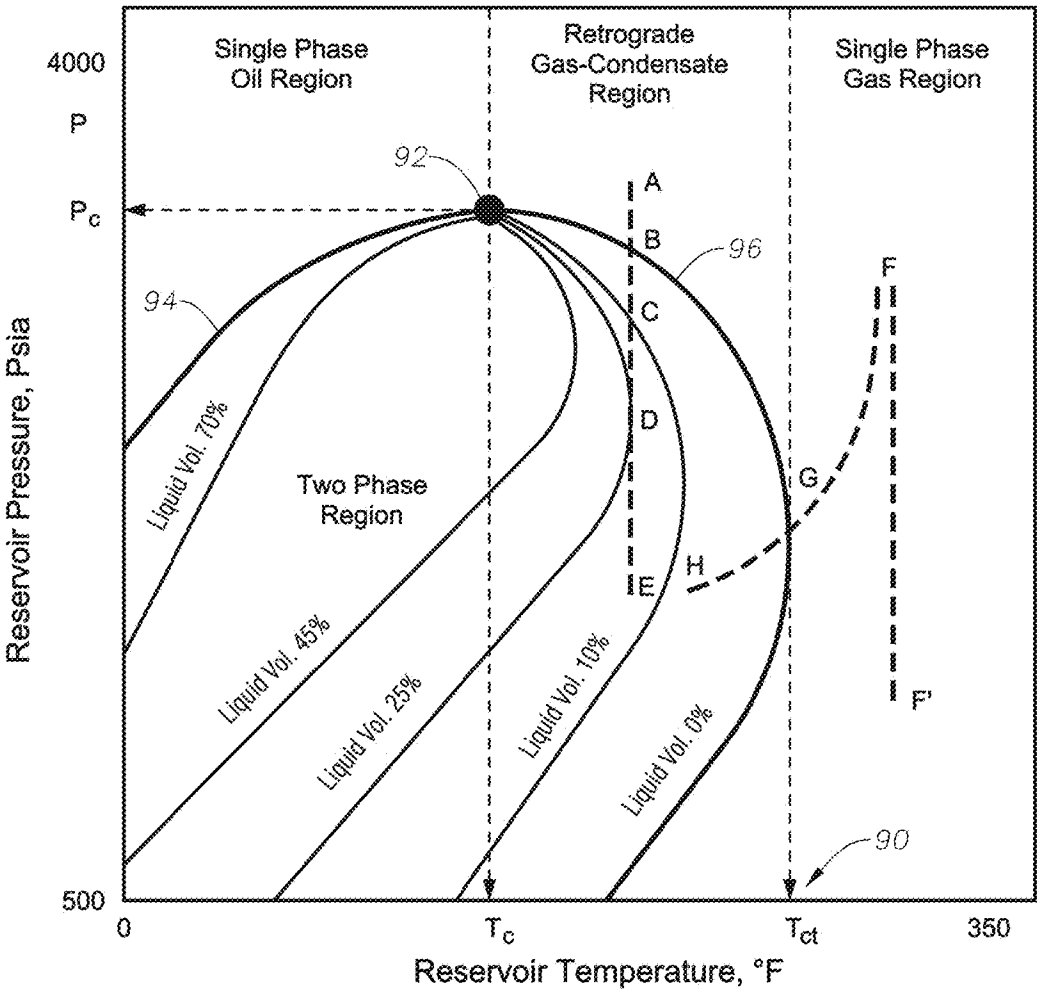
FIG. 5 is a pressure-temperature phase diagram of a reservoir fluid in one embodiment.

Referring now to FIG. 5, a pressure-temperature phase diagram of a reservoir fluid in one embodiment is shown. Pressure-temperature phase diagrams can, in some embodiments, be used to determine the heating and temperature increase necessary to be produced by the systems of FIGS. 1-3.

The severity of liquid condensation and accumulation around wellbores depends in part upon the composition of gas, operating pressure and temperature, and reservoir rock properties such as porosity and permeability. Generally, greater pressure drop, lesser near-wellbore temperature, heavier gas contents, lesser near-wellbore porosity and lesser near-wellbore permeability are the main contributing factors for liquid condensation and accumulation. Once accumulated liquids reach a certain critical saturation level, they can impede the flow path for gas from a reservoir towards the wellbore. Consequently, gas production rates and overall recovery can be reduced significantly. In many severe cases, the well must be abandoned because of the uneconomical well performance.

A cricondentherm temperature 90 ($T_{ct}$) is the maximum temperature greater than which the condensation process, or the formation of a liquid would not occur at any given reservoir pressure. In other words, at reservoir temperatures greater than point G, the hydrocarbon system will remain as a single-phase dry gas regardless of the pressure decline near the wellbore. A critical point 92 is the point at which the hydrocarbons are in a state where all intensive properties of the gas phase and liquid phase are equal. In other words, the gas and liquid phases are not easily distinguishable. At the critical point 92, the corresponding pressure is the critical pressure ($P_c$) and the corresponding temperature is the critical temperature ($T_c$). (See, for example, Ahmed, T.: "Fundamentals of Reservoir Fluid behavior," Chapter 1, Reservoir Engineering Handbook, published by Gulf Publishing Company, Texas, 2000; Craft, B. C. and Hawkins, M. F.: "Gas-Condensate Reservoirs," Chapter 2, Applied Petroleum Reservoir Engineering, published by Prentice Hall. New Jersey, 1959).

Still referring to FIG. 5, bubble point line 94 is the line representing temperature and pressure conditions separating the single-phase oil region (liquid oil) from the two-phase region (mixed liquid and gas). Dew-point line 96 is the line representing temperature and pressure conditions separating the single-phase gas region (dry gas) and the retrograde gas-condensate region (vapor gas) from the two-phase region (mixed liquid and gas). In some reservoir fluids, under differing conditions of temperature and pressure, the fluid can behave as single-phase oil, single-phase gas, retrograde gas-condensate, or two-phase fluid.

For the purpose of illustration, assuming an isothermal production process, a reservoir gas, which is initially at Point A, will become slightly foggy once the flowing bottomhole reservoir pressure reaches Point B (dew-point line 96). As pressure declines, with continuous gas production, in the two-phase region the condensation process would expedite. Therefore, liquid hydrocarbon contents in the vicinity of the wellbore could reach up to about 10% (Point C).

Saturation buildup around the wellbore can significantly reduce the gas relative permeability (see FIG. 6 and explanation as follows). The liquid saturation can increase to 25% (Point D) with continuous production at further reduced bottomhole pressures. Consequently, more severe reduction in gas relative permeability can occur. Depending on the gas composition, this process of condensation continues to a maximum limit of liquid saturation.

In many worst-case scenarios, the accumulated liquid contents around the wellbore can completely halt the gas production. In some cases, however, a further isothermal decline in bottomhole pressure, can cause reversal of the condensation process. This reversal concept is explained when, during isothermal production processes, flowing near wellbore pressure declines from Point D to Point E; where corresponding condensate saturation at Point D is 25% and at Point E is approaching back to 10%. This retrograde behavior commonly occurs because of a re-vaporization process during isothermal expansion of hydrocarbon liquid contents. However, in many cases, this is a short-lived phenomenon and occurs only at pressures close to the well abandonment stage. Moreover, this re-vaporization cannot be sufficient to repair the wellbore damage caused by liquid accumulation and to increase the gas relative permeability to a reasonable level.

Still referring to FIG. 5, initial reservoir fluid conditions can exist at greater than the cricondentherm temperature 90; for example at Point F in FIG. 5. Ideally, in an isothermal pressure decline, during the production span of reservoir life from Point F to F', there would never be liquid blockage because of the non-existence of the retrograde condensation process. However, in practice, as gas is produced, a near-wellbore cooling effect can dictate the flow path from point F to point G and further down into two-phase region at point H. This would result in the same undesirable scenario described previously; that is, because of the near-wellbore liquid accumulation, a significant loss of relative permeability to gas can occur which can lead to early well-abandonment.

In a typical hydrocarbon-bearing reservoir, as long as near-wellbore operational conditions of temperature and pressure are outside the two-phase region (for example, within the retrograde gas-condensate region or single phase gas region of FIG. 5), there would be no condensation around the wellbore and there would be optimum gas recovery under such ideal conditions. The available techniques to achieve these ideal conditions include pressure maintenance techniques and thermal techniques.

However, a major problem with pressure maintenance techniques is that they work sufficiently during the early part of reservoir life when sufficient differential pressure is available to produce gas economically at greater than the dew-point line. As production continues, the overall reservoir pressure declines. Consequently, the available differential pressure becomes insufficient to maintain an economical gas production level. Any attempt to increase flowing bottomhole pressure would further reduce the net differential pressure to less than economic limits, resulting in poor overall gas recovery. Moreover, as production continues, the composition of remaining gas in the reservoir also changes. In general, the composition of remaining gas would have greater contents of the heavier components compared to the original gas composition which is more prone to faster condensation and quicker buildup of liquid contents in the vicinity of wellbores. Pressure maintenance techniques, therefore, become even more ineffective as larger volumes of fluid are injected for pressure maintenance to keep the hydrocarbons out of the two-phase region of FIG. 5.

Still referring to FIG. 5, one advantage of using a thermal approach to keep the bottomhole wellbore conditions greater than the dew-point line 96 is that it will not only re-vaporize the condensed liquids, but also re-pressurize the bottomhole pressure. This is represented graphically in FIG. 1, in which a pressure profile before heating 40 is increased to a greater pressure profile after heating 42. This is a highly desirable scenario of downhole operational conditions. Therefore, in some embodiments of the present disclosure, a cricondentherm temperature is determined for one or more reservoir fluids under near-wellbore conditions, such that the temperature of the near-wellbore environment can be increased to maintain the fluid in a single phase gas region.

Figure 6:
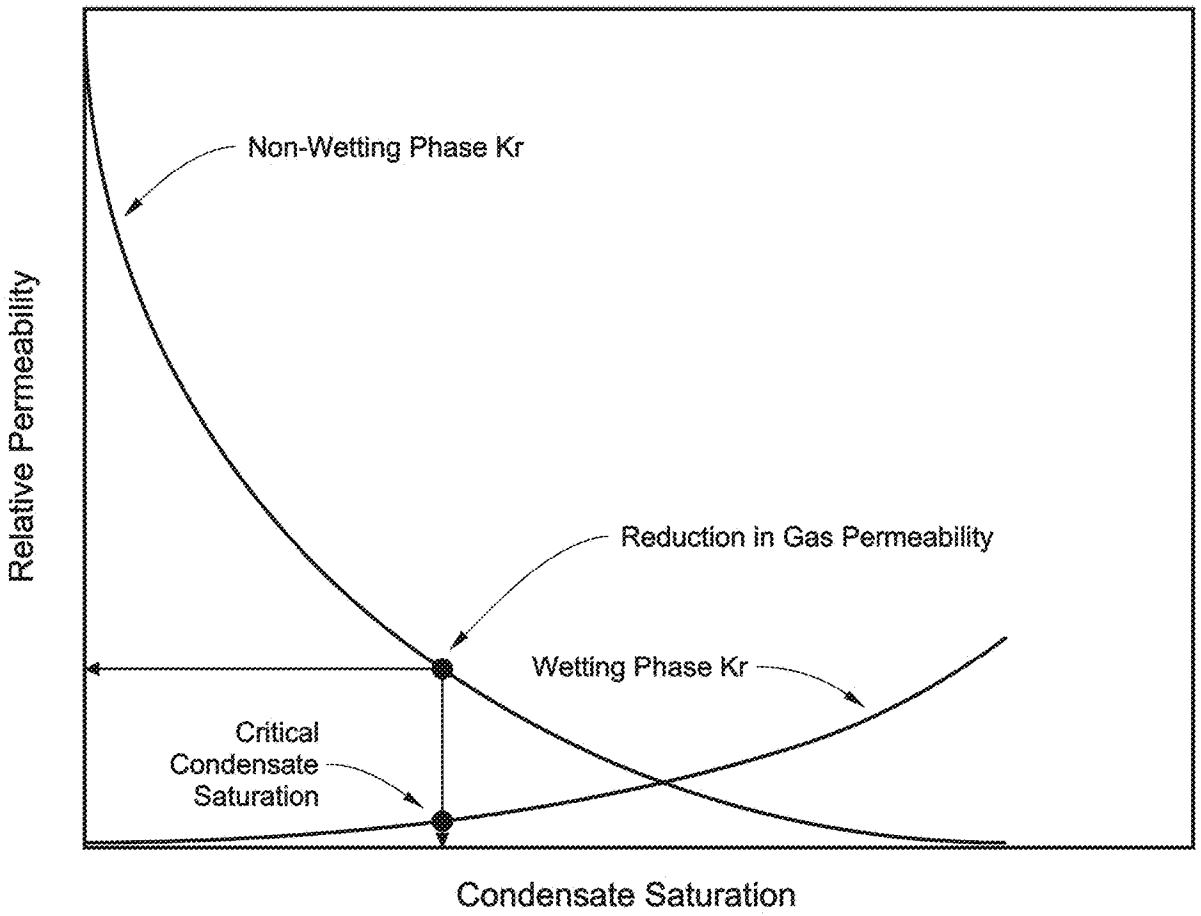
FIG. 6 is a graph showing a decrease in relative permeability of a gas at increased condensate saturation in one embodiment.

Referring now to FIG. 6, a graph showing a decrease in relative permeability of a gas at increased condensate saturation in one embodiment is shown. As shown, saturation buildup around the wellbore can significantly reduce the gas permeability.

Figure 7:
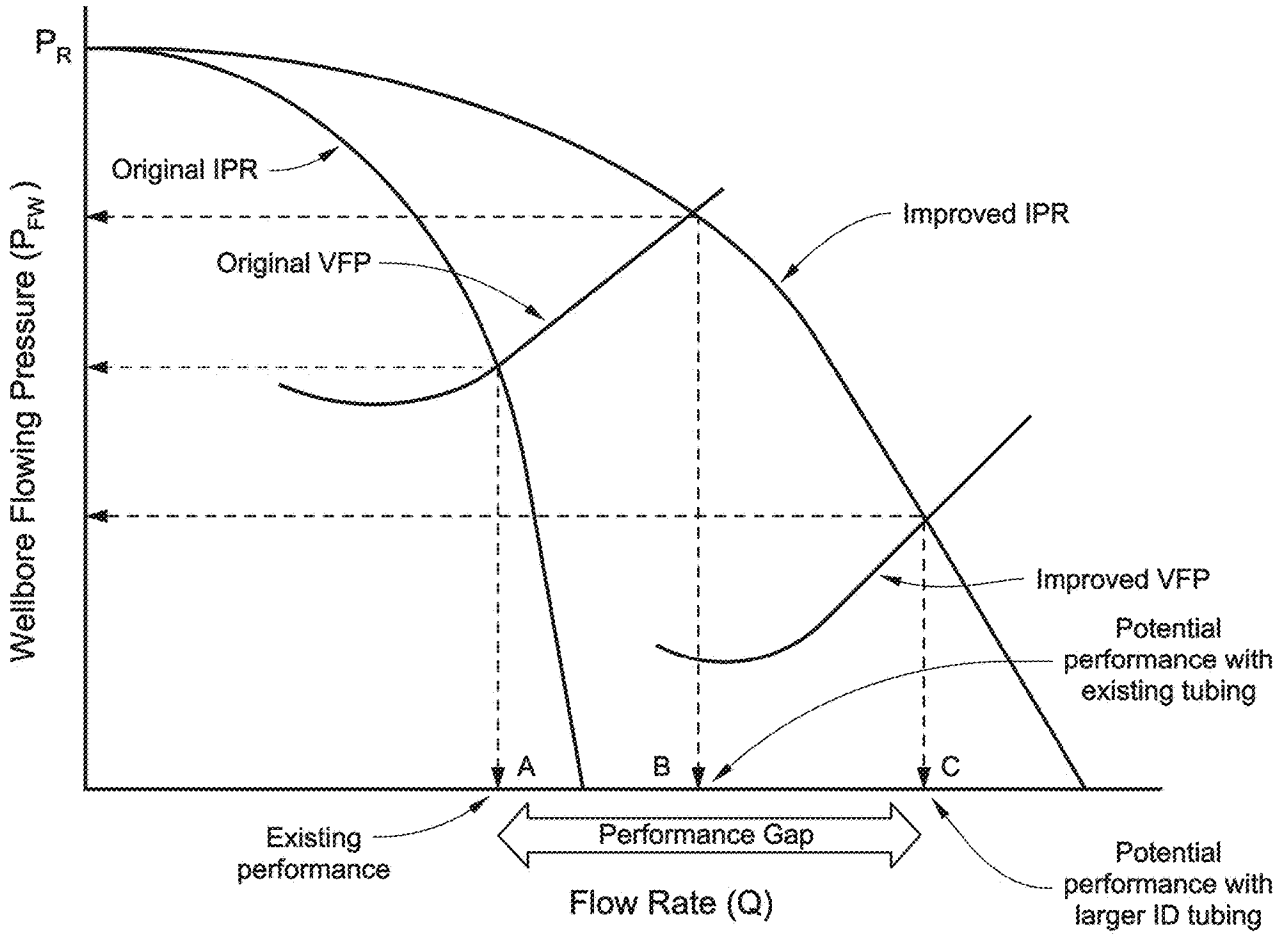
FIG. 7 is a graph showing potential performance increases for a well in one embodiment of the present disclosure.

Referring now to FIG. 7, a graph showing potential performance increase for a well in an embodiment of the present disclosure is shown. To evaluate the performance of a well, before and after the treatment by a system and method of the present disclosure, two components of a typical well production system are considered: (1) Inflow Performance Relationship (IPR) and (2) Vertical Flow Performance (VFP). The IPR is a relationship between the flowing bottomhole pressure ($P_{WF}$) and the flow rate (Q), which represents potential output a reservoir can deliver (see Equation 1 as follows). Whereas, for a specific tubing size and separator conditions, the VFP relates the flowing bottomhole pressure to the surface production rate, which represents potential output a well can deliver.

Well performance is usually obtained by conducting various deliverability tests to draw an IPR curve and then coupled with a VFP curve which is mainly based on surface piping, tubing, and the separator conditions. Well performance is also known as Productivity Index (PI). For a gas well system this is usually defined as the ratio of the gas flow rate to the corresponding pressure drawdown, for example:

$$\text{Productivity Index: } PI = \frac{Q\bar{\mu}\bar{z}}{(P_R)^2 - (P_{FW})^2}. \quad \text{Equation (1)}$$

In Equation 1, $\bar{\mu}$ (gas viscosity) & $\bar{Z}$ (gas compressibility) are evaluated at average reservoir pressure shown by Equation 2, $$\bar{P} = \frac{P_R + P_{WF}}{2}. \quad \text{Equation (2)}$$

FIG. 7 shows a combined layout where the intersection of the IPR with the VFP yields the well deliverability, an expression of what a well will actually produce for a given operating condition. Original IPR shows existing IPR and VFP before the treatment with the systems and methods of the present disclosure. Point A represents a current production rate. Improved IPR shows a post-treatment scenario, where, because of anticipated improved near-wellbore conditions brought about by the systems and methods of the present disclosure, the IPR curve is favorably shifted towards the right side of the graph in FIG. 7. Without changing the tubing and other surface conditions (or VFP), the flow rate is significantly improved as shown at Point B. This production rate can further be increased significantly to Point C if the existing tubing is replaced with a larger inside diameter tubing and adjusting the surface conditions accordingly.

Embodiments of the present disclosure, therefore, are well adapted to carry out the objects and attain the ends and advantages mentioned, as well as others that are inherent. While embodiments of the disclosure have been given for purposes of description, numerous changes exist in the details of procedures for accomplishing the desired results. These and other similar modifications will readily suggest themselves to those skilled in the art, and are intended to be encompassed within the spirit of the present disclosure and the scope of the appended claims.

Although embodiments of the present disclosure have been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges can be expressed throughout the disclosure as from about one particular value to about another particular value. When such a range is expressed, it is to be understood that another embodiment is from the one particular value to the other particular value, along with all combinations within said range.

As used throughout the disclosure and in the appended claims, the words "comprise," "has," and "include" and all grammatical variations thereof are each intended to have an open, non-limiting meaning that does not exclude additional elements or steps.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

While the disclosure has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present disclosure can suitably comprise, consist or consist essentially of the elements disclosed and can be practiced in the absence of an element not disclosed.

What is claimed is:

1. A system for deliquifying a wellbore and a near-wellbore formation by reducing presence of condensed fluid, the system comprising:

a ceramic-containing material disposed within the wellbore and proximate to a reservoir formation, where the reservoir formation comprises hydrocarbon-bearing strata; and a microwave producing unit operable to produce microwaves which heat the ceramic-containing material, where the microwave producing unit comprises a microwave antenna disposed within the wellbore and proximate the ceramic-containing material, where the ceramic-containing material is operable to be heated to a first temperature between about 800° C. and about 1000° C. by the microwave producing unit, is operable to be heated without presence of a microwave-absorbing vaporizable liquid by directly absorbing microwaves produced by the microwave producing unit, and is operable to heat the reservoir formation proximate the wellbore in a heated region to a second temperature, and where the second temperature exists in the heated region proximate the wellbore and is operable to evaporate the condensed fluid from a condensate dropout region, such that fluid condensation is mitigated near the wellbore and pay zone.

2. The system of claim 1, where the microwave antenna is disposed within the wellbore proximate a tubing string.

3. The system of claim 1, where the ceramic-containing material is operable to heat the reservoir formation proximate the heated region to a third temperature, where the third temperature is greater than a cricondentherm temperature of the reservoir formation such that hydrocarbons in the reservoir formation proximate the wellbore and pay zone only exist in gas phase.

4. The system of claim 1, where the ceramic-containing material comprises a ceramic made from natural clay, where the natural clay comprises at least one compound selected from the group consisting of: silica; alumina; magnesium oxide; potassium; iron oxide; calcium oxide; sodium oxide; titanium oxide; and mixtures thereof.

5. The system of claim 4, where the ceramic-containing material comprises between 50% and 70% by volume of the ceramic.

6. The system of claim 1, where the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide.

7. The system of claim 1, where the ceramic-containing material further comprises gravel particulate.

8. The system of claim 1, where the wellbore comprises an open-hole liner.

9. The system of claim 8, where the wellbore is under-reamed.

10. The system of claim 8, where the wellbore further comprises cement and a casing with perforations.

11. The system of claim 1, where the condensed fluid is at least one material selected from the group consisting of: water; wax; asphaltenes; gas-hydrates; and mixtures thereof.

12. A method of using the system of claim 1 to deliquify the wellbore and the near-wellbore formation, the method comprising the steps of:

activating the microwave producing unit;

heating the ceramic-containing material to the first temperature without presence of a microwave-absorbing vaporizable liquid, the first temperature being selected such that the first temperature is operable to sufficiently heat the reservoir formation proximate the wellbore to the second temperature;

monitoring the wellbore for presence of liquids in a production fluid; and adjusting an operating parameter of the microwave producing unit to directly create sufficient heat in the ceramic-containing material without presence of a microwave-absorbing vaporizable liquid to be transferred to the reservoir formation in the heated region proximate the wellbore, such that fluid condensation is mitigated near the wellbore and pay zone.

13. The method of claim 12, where the operating parameter of the microwave is at least one operating parameter selected from the group consisting of: a positioning of the microwave producing unit proximate the wellbore; an operating power level of the microwave producing unit; a number of microwave producing points on the microwave antenna; and a period of application of microwaves to the ceramic-containing material.

14. A method of reducing presence of condensed fluid in a wellbore and a near-wellbore formation, the method comprising the steps of:

disposing a ceramic-containing material within the wellbore and proximate to a reservoir formation, where the reservoir formation comprises hydrocarbon-bearing strata;

providing a microwave producing unit operable to heat the ceramic-containing material, where the microwave producing unit comprises a microwave antenna disposed within the wellbore and proximate the ceramic-containing material;

activating the microwave producing unit to heat the ceramic-containing material without presence of a microwave-absorbing vaporizable liquid, where the ceramic-containing material is operable to directly absorb microwaves produced by the microwave producing unit and is operable to be heated to a first temperature between about 800° C. and about 1000° C. by the microwave producing unit; and the first temperature operable to heat the reservoir formation proximate the wellbore in a heated region to a second temperature, where the second temperature in the heated region is sufficient to evaporate the condensed fluid from a condensate dropout region, such that fluid condensation is mitigated near the wellbore and pay zone.

15. The method of claim 14, where the microwave antenna is disposed within the wellbore proximate a tubing string.

16. The method of claim 14, further comprising the step of heating the reservoir formation proximate the heated region to a third temperature, where the third temperature is greater than a cricondentherm temperature of the reservoir formation such that hydrocarbons in the reservoir formation proximate the wellbore and pay zone only exist in gas phase.

17. The method of claim 14, where the ceramic-containing material comprises a ceramic made from natural clay, where the natural clay includes at least one compound selected from the group consisting of: silica; alumina; magnesium oxide; potassium; iron oxide; calcium oxide; sodium oxide; titanium oxide; and mixtures thereof.

18. The method of claim 17, where the ceramic-containing material comprises between 50% and 70% by volume of the ceramic.

19. The method of claim 14, where the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide.

20. The method of claim 14, where the step of disposing a ceramic-containing material within the wellbore further comprises mixing the ceramic-containing material with gravel particulate.

21. The method of claim 14, where the step of disposing a ceramic-containing material within the wellbore further comprises disposing the ceramic-containing material within an open-hole liner.

22. The method of claim 14, where the condensed fluid is at least one material selected from the group consisting of: water; wax; asphaltenes; gas-hydrates; and mixtures thereof.

23. A method for constructing a wellbore in a hydrocarbon-bearing formation to reduce formation of condensed fluid near the wellbore, the method comprising the steps of:

forming the wellbore in the hydrocarbon-bearing formation, the wellbore comprising a wellbore wall, the wellbore wall defining an interface between the wellbore and the hydrocarbon-bearing formation;

positioning a liner into the wellbore such that an annular void is formed between an exterior-directed surface of the liner and an interior-directed surface of the wellbore wall;

introducing a ceramic-containing material into the annular void and proximate to the hydrocarbon-bearing formation;

securing the liner such that the ceramic-containing material is maintained in the annular void at a location to be treated with microwave heating; and introducing into the wellbore a microwave producing unit operable to produce microwaves which heat the ceramic-containing material, where the microwave producing unit comprises a microwave antenna disposed within the wellbore and proximate the ceramic-containing material, where the ceramic-containing material is operable to be heated to a first temperature between about 800° C. and about 1000° C. by the microwave producing unit, is operable to be heated without presence of a microwave-absorbing vaporizable liquid by directly absorbing microwaves produced by the microwave producing unit and is operable to heat the reservoir formation proximate the wellbore in a heated region to a second temperature, and where the second temperature exists in the heated region proximate the wellbore and is operable to evaporate condensed fluid from a condensate dropout region, such that fluid condensation is reduced near the wellbore and pay zone.

24. The method according to claim 23, where the step of forming the wellbore further comprises the step of extending a radial circumference of a first portion of the to a radially-larger, under-reamed circumference relative to a second portion of the wellbore, where a radial circumference of the second portion of the wellbore is less than the radial circumference of the radially-larger, under-reamed circumference.

25. The method according to claim 23, further comprising the step of disposing cement within the annular void.

26. The method according to claim 25, further comprising the step of disposing a casing within the annular void.

27. The method according to claim 26, further comprising the step of perforating the cement and the casing, such that a hydrocarbon fluid flow is permitted through the perforations radially inward from the wellbore wall.

28. The method of claim 23, where the step of introducing into the wellbore the microwave producing unit further comprises disposing the microwave producing unit within the wellbore proximate a tubing string.

29. The method of claim 23, where the ceramic-containing material is operable to heat the reservoir formation proximate the heated region to a third temperature, where the third temperature is greater than a cricondentherm temperature of the reservoir formation such that hydrocarbons in the hydrocarbon-bearing formation proximate the wellbore and pay zone only exist in gas phase.

30. The method of claim 23, where the ceramic-containing material comprises a ceramic made from natural clay, where the natural clay comprises at least one compound selected from the group consisting of: silica; alumina; magnesium oxide; potassium; iron oxide; calcium oxide; sodium oxide; titanium oxide; and mixtures thereof.

31. The method of claim 30, where the ceramic-containing material comprises between 50% and 70% by volume of the ceramic.

32. The method of claim 23, where the ceramic-containing material comprises a ceramic made from natural clay, where the natural clay comprises by weight 67.5% silica, 22.5% alumina, 3.10% magnesium oxide, 0.85% potassium, 0.70% iron oxide, 0.35% calcium oxide, 0.30% sodium oxide, and 0.30% titanium oxide.

33. The method of claim 23, where the ceramic-containing material further comprises gravel particulate.

34. The method of claim 23, where the step of positioning a liner further comprises the step of positioning an open-hole liner within the wellbore.

35. The method of claim 23, where the condensed fluid is at least one material selected from the group consisting of: water; wax; asphaltenes; gas-hydrates; and mixtures thereof.

36. A method of reducing presence of condensed fluid in a wellbore and a near-wellbore formation, the method comprising the steps of:

disposing a ceramic-containing material within the wellbore and proximate to a reservoir formation, where the reservoir formation comprises hydrocarbon-bearing strata;

providing a microwave producing unit operable to heat the ceramic-containing material, where the microwave producing unit comprises a microwave antenna disposed within the wellbore and proximate the ceramic-containing material;

determining a cricondentherm temperature of the reservoir formation in a condensate dropout region;

activating the microwave producing unit to heat the ceramic-containing material, where the ceramic-containing material is operable to directly absorb microwaves produced by the microwave producing unit without a microwave-absorbing vaporizable liquid;

heating the ceramic-containing material to a first temperature, the first temperature operable to heat the reservoir formation proximate the wellbore in a heated zone to a second temperature; and heating the reservoir formation proximate the condensate dropout region to a third temperature, where the third temperature is greater than the cricondentherm temperature of the reservoir formation in the condensate dropout region such that hydrocarbons in the reservoir formation proximate the wellbore and pay zone only exist in gas phase.

* * * * *